US006688795B1

(12) United States Patent
Jacob et al.

(10) Patent No.: US 6,688,795 B1
(45) Date of Patent: Feb. 10, 2004

(54) APPLICATOR PACKAGE WITH DISPOSABLE APPLICATOR PAD ASSEMBLY

(75) Inventors: Christophe Jacob, Saint Pierre d'Autils (FR); Herve F. Bouix, New York, NY (US)

(73) Assignee: E-L Management Corp., Melville, NY (US)

( * ) Notice: Subject to any disclaimer, the term of this patent is extended or adjusted under 35 U.S.C. 154(b) by 0 days.

(21) Appl. No.: 10/288,832

(22) Filed: Nov. 6, 2002

(51) Int. Cl.[7] ..... B43K 8/12; B43M 11/06

(52) U.S. Cl. ..... 401/207; 401/202; 401/205; 401/262

(58) Field of Search ..... 401/126, 196, 401/202–205, 207, 262, 283, 290, 291

(56) References Cited

U.S. PATENT DOCUMENTS

| | | | | |
|---|---|---|---|---|
| 3,266,079 A | 8/1966 | Schwartzman | ..... | 15/596 |
| 3,481,676 A | 12/1969 | Schwartzman | ..... | 401/134 |
| 3,601,287 A | 8/1971 | Schwartzman | ..... | 222/146 H |
| 4,133,614 A | 1/1979 | Baginski et al. | ..... | 401/206 |
| 4,747,720 A | 5/1988 | Bellehumeur et al. | ..... | 401/205 |
| 4,973,181 A | 11/1990 | Jankewitz | ..... | 401/199 |
| 5,240,339 A | 8/1993 | DeForest et al. | ..... | 401/207 |
| 5,577,851 A | 11/1996 | Koptis | ..... | 401/202 |
| 5,931,591 A | 8/1999 | McCracken | ..... | 401/6 |
| 6,045,279 A | 4/2000 | Follis | ..... | 401/6 |
| 6,082,919 A | 7/2000 | de Laforcade | ..... | 401/190 |

FOREIGN PATENT DOCUMENTS

| | | | |
|---|---|---|---|
| EP | 1094011 A1 | 4/2001 | ..... B65D/47/42 |

*Primary Examiner*—Tuan N. Nguyen
(74) *Attorney, Agent, or Firm*—Martin Haerter

(57) ABSTRACT

A product package includes a disposable applicator pad assembly. The applicator pad assembly has a porous foam pad with an elastomer strip bonded to the perimeter of the pad. The elastomer strip is compressed between a retaining ring and the package to impermeably secure the pad assembly to the package. A cap is provided to cover the applicator pad. A sealing skirt depending from the cap is dimensioned to contact an inner annular portion of the strip in sealing engagement to prevent evaporation and to protect the applicator pad and package contents from contamination.

14 Claims, 5 Drawing Sheets

APPLICATOR PACKAGE WITH DISPOSABLE APPLICATOR PAD ASSEMBLY

BACKGROUND OF THE INVENTION

1. Field of the Invention

The present invention relates to product storage packages that include applicator means. In particular, the present invention is directed to bottles or jars for dispensing fluid products such as liquids, creams or powders through an applicator pad on one end of the container. More particularly, the invention is directed to a disposable applicator pad assembly for such a container.

2. Description of the Prior Art

Product packages that combine a product storage reservoir and a built in porous applicator pad are known, as shown, for example in U.S. Pat. Nos. 3,481,676, 4,133,614 or 5,577,851. A problem with such packages is that the applicator pad may become soiled, clogged, worn or damaged before the contents of the product storage reservoir are fully utilized. Since the applicator pads are often permanently fixed to the package, cleaning, repairing or replacing the applicator pad may be impractical or impossible without compromising the airtight qualities or structural integrity of the package proper.

Lotion applicators with removable applicator pads are also known. For example, U.S. Pat. No. 5,931,591 discloses a removable applicator cap with a reduced diameter opening surrounded by an elastomeric band . While this arrangement may be suitable for a lotion applicator having a head portion that is substantially larger in dimension than a supporting neck portion, it is not suitable for a typical consumer package having an applicator pad that is the same size as or smaller than the neck of the package. U.S. Pat. No. 6,045,279 discloses a lotion applicator with a sponge assembly that is removable and replaceable. The sponge assembly is fastened to the lotion applicator by way of a hook and pile type fastening. While this arrangement may be suitable for a lotion applicator as shown, in terms of materials and manufacturing, it is not sufficiently cost effective for use in mass production of product packaging that includes an applicator pad. It is also noted that for at least the following reasons, lotion applicators such as those described above are, from an economic standpoint, substantially different devices from product packages. In general, higher costs (including materials, manufacturing and retail) are tolerated for lotion applicators such as those shown in the references above because they are durable and may be refilled to be used innumerable times. In contrast, the cost of a typical product package must be kept to a minimum because, among other reasons, it is generally disposed of after substantially all of a product stored within has been dispensed.

Accordingly, there is a need for a cost effective, mass produce-able product package having an applicator pad that is easily removable for cleaning, repair or replacement.

BRIEF SUMMARY OF THE INVENTION

The present invention is directed to a mass produce-able product package having an applicator pad that is easily removable for cleaning, repair or replacement. The applicator package includes a container for storing a consumer product such as, for example, a cosmetic, a lotion, a personal care product or a pharmaceutical. A screen is supported on the container and spans an opening in the container. A disposable applicator pad assembly sits over the screen. The applicator pad assembly includes a porous foam pad with an elastomer strip fixed to its perimeter. A retaining ring that is selectively attachable to the container (either directly to the container or indirectly to the container by way of an intervening part, e.g., the screen member) is dimensioned to compress at least an outer annular portion of the elastomer strip in sealing engagement against the container or screen to secure the applicator pad assembly to the package.

The invention is also directed to the applicator pad assembly including the porous foam pad with the elastomer strip fixed to the perimeter of the pad. The elastomer strip may be fixed to the porous foam pad by, for example, adhesion, bonding, welding or overmolding. In any case, the elastomer strip is fixed to the porous foam pad such that when the pad assembly is secured on a package by a retaining ring, the elastomer strip is compressed to form an impervious seal between the ring and the structure supporting the ring.

A selectively removable cap may also be provided for the package. The cap is fastened to the package by, for example, friction-fit, snap-fit, threads or bayonet means. A skirt depending from the cap forms an impervious seal with the package by contacting a portion of the elastomer strip of the applicator pad assembly.

The invention provides a means of replacing or cleaning the applicator pad as the product is being consumed while maintaining the structural integrity and impermeable qualities of the package. In this manner, a hygienic condition may be maintained on the applicator surface. Additionally, the user has an opportunity to change the application characteristics of the package by changing the applicator pad assembly.

DETAILED DESCRIPTION OF THE INVENTION

Figure 1:
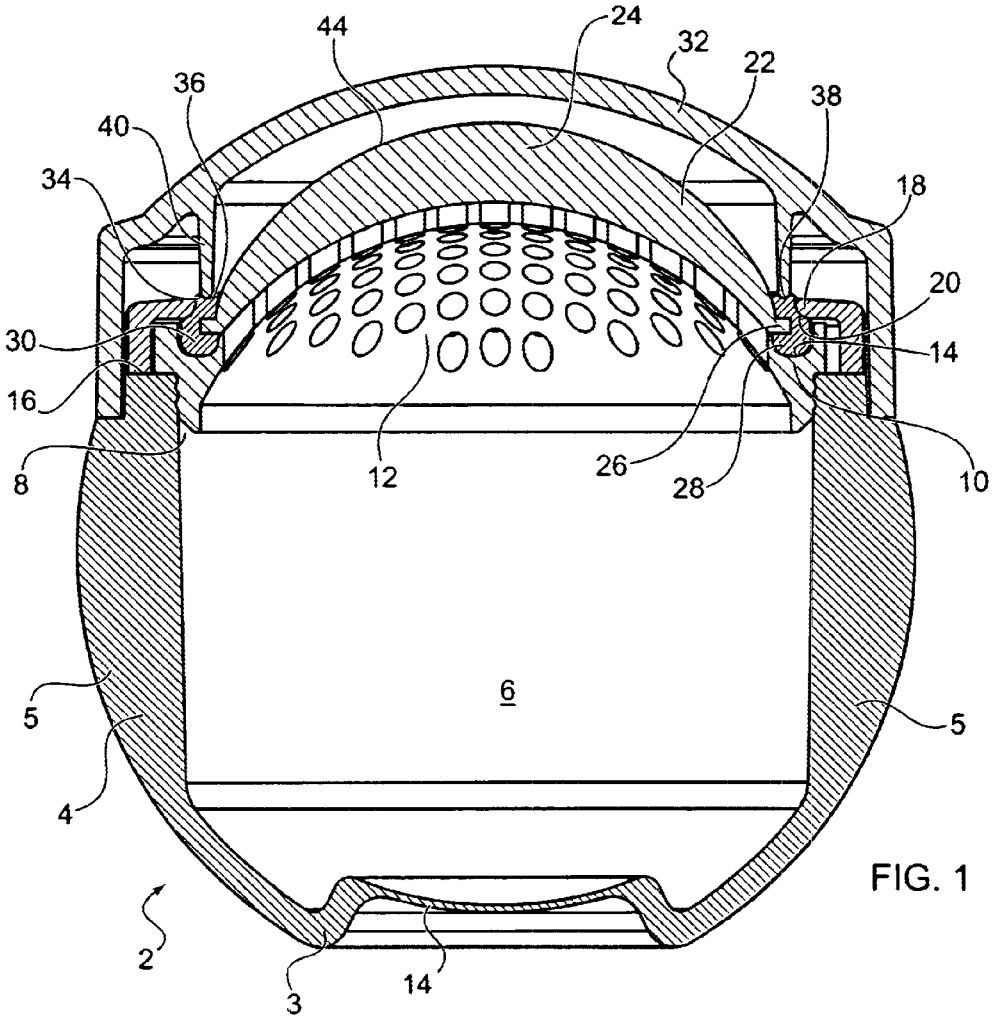
FIG. 1 is a cross-sectional view of the applicator package incorporating the invention.

Referring now to FIG. 1, an applicator package, shown generally at reference number 2, is disclosed comprising a container 4 with a bottom wall 3 and peripheral wall 5 defining a storage reservoir 6 for storing a quantity of product (not shown). The container 4 has a dispenser opening 8 for dispensing the product from the storage reservoir 6. A screen member 10 spans the dispenser opening 8 and is preferably impermeably attached to the container 4. The screen member 10 may, after product has been provided to the storage reservoir 6, be attached to the container permanently, by, for example, bonding, welding or molding it in place. Alternatively, the screen member 10 may be removably attached to the container by way of, for example, a friction fit, an interference fit, a snap fit, cooperating threads or a suitable bayonet arrangement. Such attachments and the means for making them impermeable are well known in the art of package construction. A perforated portion 12 of the screen member 10 is positioned approximately centrally in the screen member 10 to be in fluid communication with the storage reservoir 6 by way of the dispenser opening 8.

A first annular bearing surface 14 is defined about the perforated portion 12 on the screen member 10. The first annular bearing surface 14 is at least in part upwardly directed. While it is preferred that the first annular bearing surface 14 be defined on the screen member 10, it will be understood by those skilled in the art that the first annular bearing surface 14 could alternatively be defined on an upwardly directed surface of the container 4, such as, for example, the surface 16 on which the screen member 10 rests.

Figure 5:
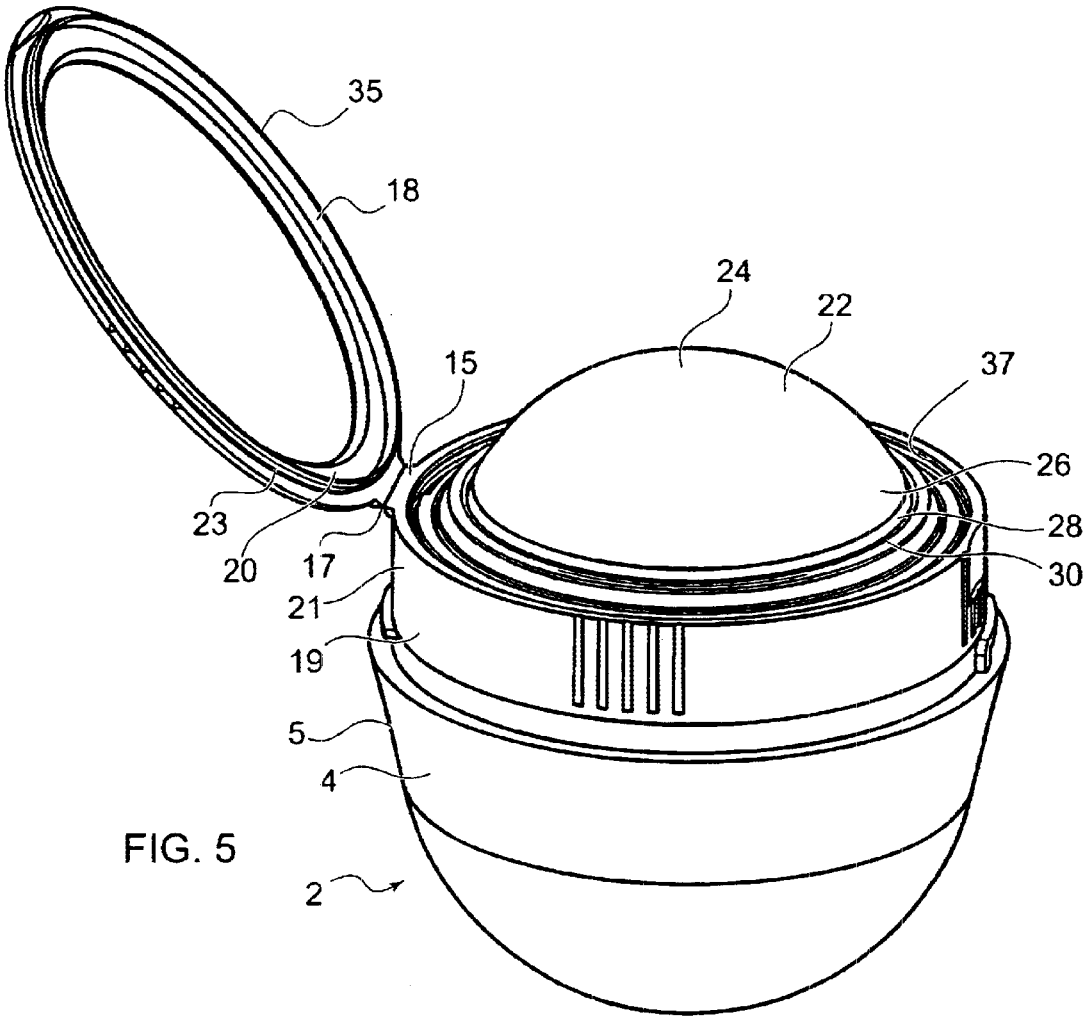
FIG. 5 is a perspective view of an alternative embodiment of the applicator package.
Figure 6:
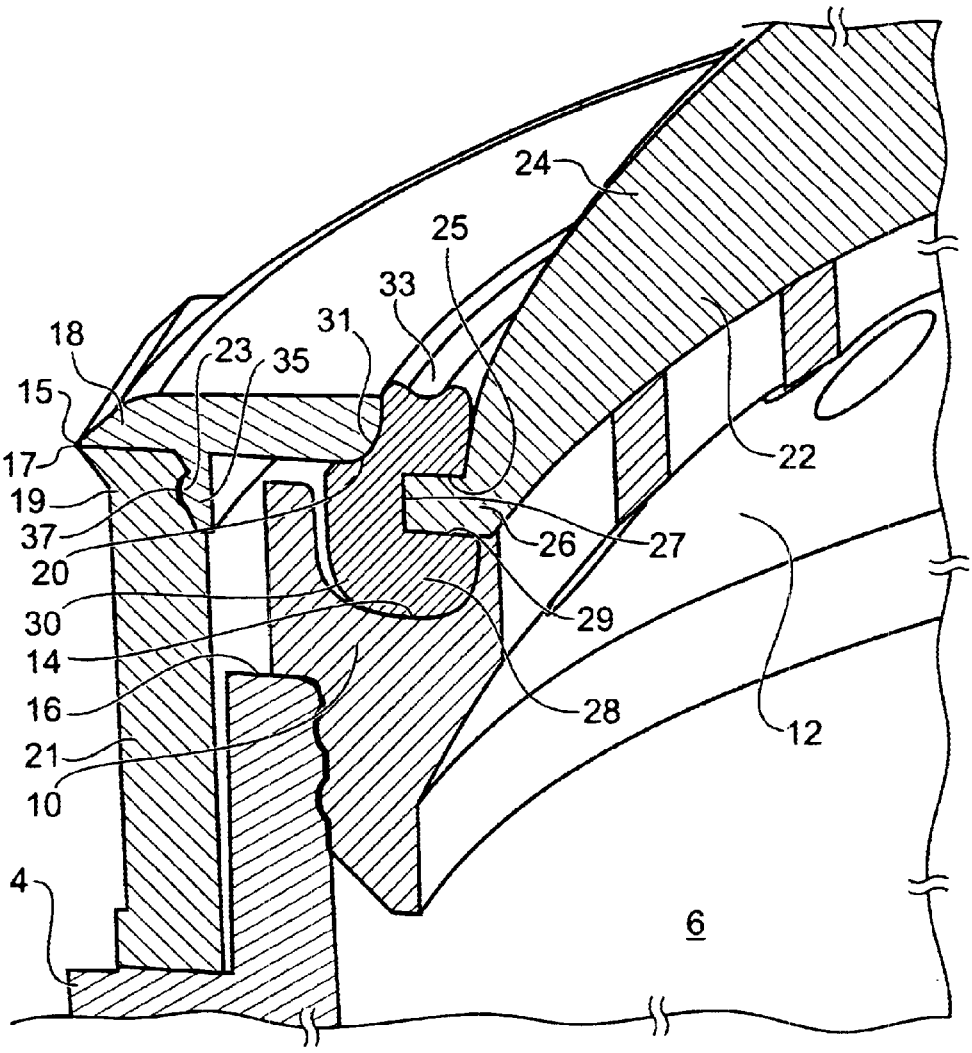
FIG. 6 is a detail view of a portion of the applicator package shown in FIG. 5.
Figure 7:
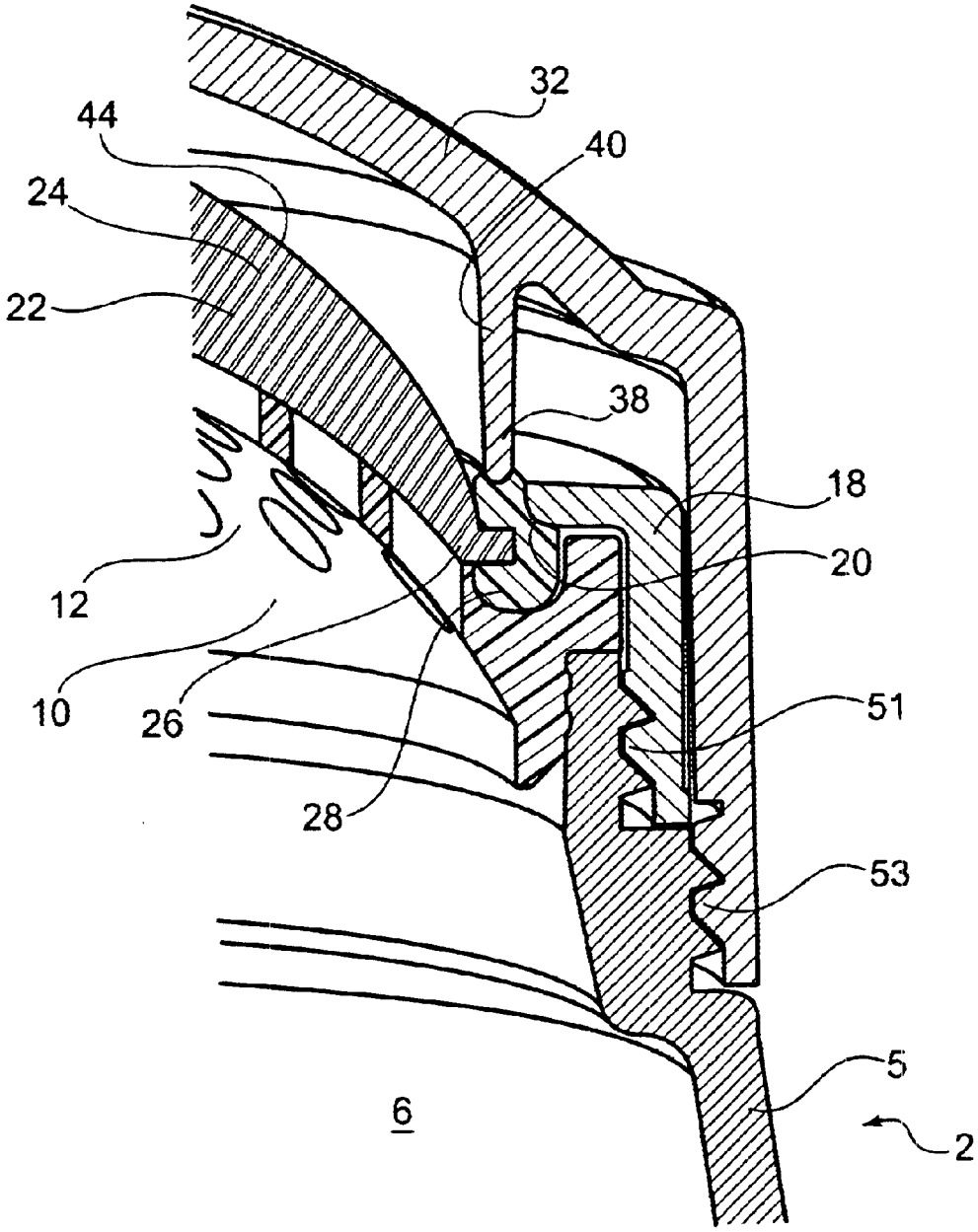
FIG. 7 is a detail view of an alternate embodiment of the applicator package.

A retaining ring 18 is selectively attachable to the container 4, about the perforated portion of the screen member 10. It will be understood that by the phrase "attachable to the container" it is meant that the retaining ring 18 will be either attachable to the container 4 indirectly by way of the screen member 10 as shown, or, alternatively, the retaining ring 18 will be attachable to the container 4 with other intervening parts or no intervening parts. The retaining ring 18 is attachable to the container 4 by way of a friction fit, an interference fit, a snap fit, cooperating threads (as shown generally at reference number 51 in FIG. 7) or a suitable bayonet arrangement. Alternatively, the retaining ring 18 may be incorporated into a retainer assembly 19 attached to the container 4 (see FIGS. 5 and 6). The retainer assembly 19 includes a base ring 21 attached to the container 4 by conventional means, e.g., cooperating threads, friction fit, interference fit, bayonet, chemical or physical bonding, etc. The retaining ring 18 is connected to the base ring 21 by a hinge-type connection 15, for example, a living hinge 17, that allows the retaining ring 18 to pivot from an open position away from the screen member to a closed position about the periphery of the screen member. A snap fit engagement of the retaining ring 18 to the base ring 21 holds the retaining ring 18 in the closed position securely about the periphery of the screen member. In the embodiment shown, the snap fit engagement comprises an outwardly directed bead 23 engaging an inwardly directed channel 37 (see FIG. 6). The bead 23 projects outwardly from an annular skirt 35 depending from retaining ring 18. The channel 37 is formed in an inwardly directed wall of base ring 21.

The retaining ring 18 defines a second annular bearing surface 20 cooperatively dimensioned and adapted to face the first annular bearing surface 14 when the retaining ring 18 is closely attached on the screen member 10. The second annular bearing surface 20 is at least in part downwardly directed.

Figure 2:
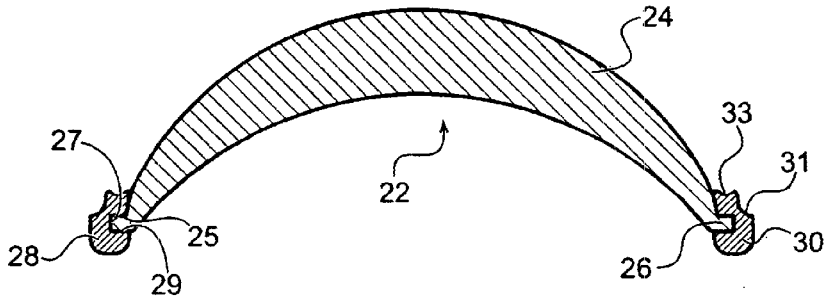
FIG. 2 is a cross-sectional view of an applicator pad assembly according to the invention.
Figure 3A:
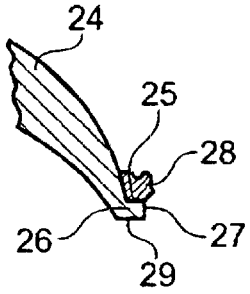
FIGS. 3*a*–3*f* are partial sectional views of various embodiments of the applicator pad assembly according to the invention.
Figure 3B:
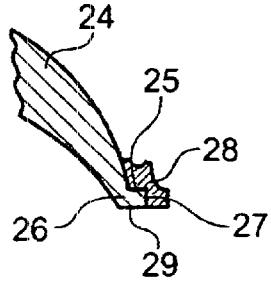
Figure 3C:
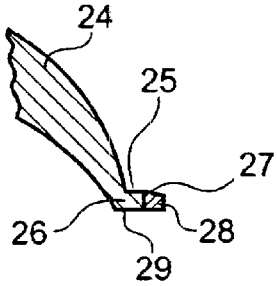
Figure 3D:
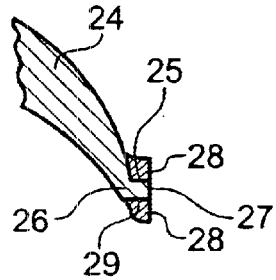
Figure 3E:
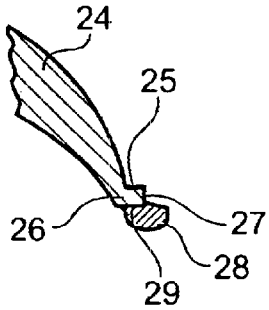
Figure 3F:
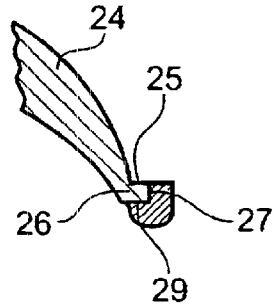
Figure 4:
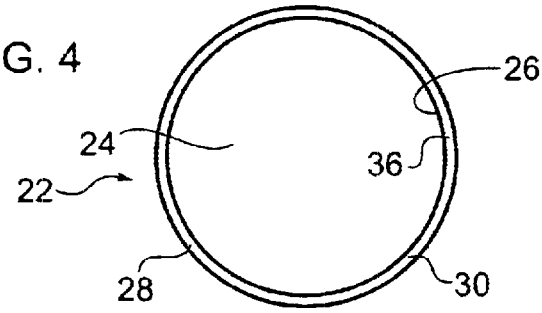
FIG. 4 is a plan view of the applicator pad assembly of FIG. 2.

As shown in FIG. 1, a disposable applicator pad assembly 22 is provided over the screen member 10. The disposable applicator pad assembly 22, shown in FIGS. 2 and 4 separated from the package 2 for greater clarity, has a porous foam pad 24 dimensioned to cover and be at least partially supported by the perforated portion 12 of the screen member 10. Continuously along a perimeter edge 26 of the porous foam pad 24, at least one elastomer strip 28, i.e., a strip made of an elastomeric material, is securely fixed. The at least one elastomer strip 28 is fixed to the perimeter edge 26 of the foam pad 24 by, for example, welding, adhering, bonding or molding. Preferably, the strip 28 is fixed, as best shown in FIG. 2, about three sides 25, 27, 29 of the perimeter edge 26 of the foam pad 24. Alternatively, the strip 28 is fixed to one or two of the three sides 25, 27, 29 of the perimeter edge 26, as shown in the alternative embodiments of FIGS. 3*a*–3*f*. At least an outer annular portion 30 of the strip 28 is dimensioned to be received and compressed in sealing engagement between the first annular bearing surface 14 and the second annular bearing surface 20 when the retaining ring 18 is secured to the container 4 in a position about the perimeter of the applicator pad assembly 22. A portion of the perimeter edge 26 of the foam pad 24 may also be compressed between the bearing surfaces 14 and 20. Additionally, the strip 28 may be provided with channels or other suitable surface details to accommodate one or more bearing surfaces. For example, in the strip 28 shown in FIGS. 2 and 6, channels 31 and 33 are provided to accommodate the second and third annular bearing surfaces 20 and 34, respectively.

While the screen member 10 and applicator pad assembly 22 are shown to provide a dome shaped (i.e., convex) application surface 44, it will be understood that the application surface 44 may take any suitable shape or form including but not limited to, flat, concave, wavy, ridged, etc., by merely molding the desired shape of the foam and selecting a suitable and/or corresponding shape for the supporting screen member.

A selectively removable cap 32 may be provided for attachment to the container 4, either directly as shown, or by way of the screen member 10, the retaining ring 18 or another intervening member (not shown). The cap 32 is attached by well known means, such as, for example, friction fit, snap fit, cooperating threads (as shown generally at reference number 53 in FIG. 7) or a bayonet-type connection. When the cap 32 is attached to the container 4 by way of threads or a bayonet-type mount, and the retainer ring 18 or retainer assembly 19 is also attached by way of threads or a bayonet mount, preferably the threads or bayonet-type mount of each of the cap and the retainer ring 18, or the cap and the retainer assembly 19, are oppositely pitched, such that removing the cap will not loosen the retainer ring or retainer assembly.

The cap is dimensioned to cover and protect the applicator pad assembly 22 and application surface 44 when the package 2 is not in use. A third annular bearing surface 34 is defined by the cap 32 and adapted to contact in sealing engagement an inner annular portion 36 of the elastomer strip 28. In the preferred embodiment, the third annular bearing surface 34 is provided on a lower end 38 of a sealing skirt 40 depending from the cap 32. When the cap 32 is securely attached to the container, the third annular bearing surface 34 contacts in sealing engagement the inner annular portion 36 of the elastomer strip 28.

The package is preferably manufactured using conventional manufacturing methods and assembly practices, such as, for example, injection molding and extrusion blow molding. The container, screen member, retainer ring and cap may be made from materials such as, for example, resins or elastomers, including but not limited to polypropylene (PP), polyethylene (PE) (high or low density), PET, or a combination of the foregoing. For example, a compound of PP and PE can be used in a ratio of 70/30, respectively, or 50/50. A material that is particularly well suited for making the screen member is polyoxymethylene (POM), such as, for example, Delrin, a registered trademark of DuPont de Nemours, Wilmington, Del.

A suitable material for the porous foam pad 24 is any closed or open cell foam with any conventional pore size made of a material that is compatible with the product to be dispensed. Examples of such foam include polyester, polyether, polyvinyl chloride and polyurethane. Polyurethane is the preferred material. Although at a minimum, the foam material must have sufficient porosity to permit passage of the product to be stored within the package, the porosity of the material may be selected to provide any flow rate between a relatively high flow rate and a relatively low flow rate. For example, adequate quantities of a cosmetic formula such as a fluid foundation or a skincare cream can pass through a low density, small open cell polyurethane foam having a thickness of 3mm. In any case, by taking into account the type of foam material, the density of the foam and the thickness of the foam pad, the flow rate of a particular formula through the foam material can be determined without undue experimentation. Though less desirable, alternatively, the formulation of a particular product may be adjusted to flow at a particular rate through a particular density of foam material.

A suitable material for the elastomer strip is elastomer thermoplastic that is capable of being adhered to, molded to or welded to the selected foam material of the applicator pad. The material for the elastomer strip and the material for the porous foam pad must be selected to have chemical properties which will permit a secure bond when the elastomer and the foam are adhered, molded or welded together. A preferred elastomer thermoplastic that is known to exhibit good adhesion to polyurethane foams, particularly in the over-molding process, is available from THERMOPLASTIQUES COUSIN-TEISSIER S.A., Tiffauges, France. The particular elastomer thermoplastic is identified by the manufacturer as téfabloc (trademark) TE Fl 817 52A.

While it is contemplated that the material of the porous foam pad will be selected to permit the free flow of a particular formula by capillary action, the applicator package 2 may optionally be provided with means for pushing product from within the storage reservoir 6. The means may comprise a wall portion of the container 4 that is resiliently deformable such that the volume of the storage reservoir 6 is reduced sufficiently to move a quantity of product through the perforated portion 12 of the screen member 10 and into and/or through the foam pad 24. The means for pushing may comprise a deformable panel 40 molded integrally into the bottom wall 3 of the container, as shown, or a similar deformable panel 40 located on the peripheral wall 5 (not shown). The deformable panel 40 may be made of the same material as the bottom wall 3 and peripheral wall 5 of the container, or alternatively, may be made of an elastomeric material that is impermeably bonded, welded or molded into an opening in the container bottom wall 3 or peripheral wall 5.

Alternatively, the entire container 4 may be a flexible container such as, for example, a squeezable tube or bottle.

The application surface 44 of the foam pad 24 may be coated with a surface treatment to achieve desired application characteristics or to improve the tactile feel of the pad. For example, flocking may be provided to surface 44 to improve the tactile feel of the pad, or grit can be provided to the surface 44 to yield a scrubbing effect. Because the applicator pad assembly 22 is easily removable and exchangeable, a user may conveniently change the pad when necessary due to soiling, clogging or damage. Additionally, a user may conveniently exchange a pad having one porosity, style, shape or surface treatment for another pad having a different style, shape, porosity or surface treatment, etc.

The invention can be used for any and all types of packaging for paste, liquid or powder products that would benefit from an interchangeable and/or cleanable applicator pad while maintaining package structural integrity and air tightness. The invention may be used, for example, in packages for cosmetics (e.g., fluid foundation, skincare cream, body lotion, etc.), pharmaceuticals, treatment products, personal care products, or the like. The invention yields a package with an applicator pad that is conveniently removable for cleaning, servicing or replacement. The package structural integrity is maintained throughout the removal and replacement of the applicator pad. The cap provided over the applicator pad prevents exposure to air and contamination. And the elastomer strip about the applicator pad ensures the secure engagement of the pad in the package structure and provides impermeable seals between the applicator pad, the retaining ring, the cap and the container. In contrast to the prior art, the impermeable seals of the present invention permit the long-term storage of products having relatively volatile formulas.

While the invention has been described and illustrated as embodied in preferred forms of construction, it will be understood that various modifications may be made in the structure and arrangement of the parts without departing from the spirit and the scope of the invention recited in the following claims.

What is claimed is:

1. An applicator package comprising:

a container defining a storage reservoir, the container having a dispenser opening, a screen member having a perforated portion, the screen member attached to the container, the screen member spanning the dispenser opening such that the perforated portion is in fluid communication with the storage reservoir by way of the dispenser opening;

a first annular bearing surface defined on one of the container or the screen member;

a retaining ring selectively attachable about the perforated portion of the screen member, the retaining ring defining a second annular bearing surface cooperatively dimensioned and adapted to face the first annular bearing surface when the ring is attached about the perforated portion of the screen member; and a disposable applicator pad assembly comprising:

a porous foam pad dimensioned to cover and be at least partially supported by the perforated portion of the screen member, the pad having a perimeter edge, and an elastomer strip fixed to the perimeter edge of the pad, at least an outer annular portion of the strip dimensioned to be received and compressed in sealing engagement between the first annular bearing surface and the second annular bearing surface when the retaining ring is attached to the package.

2. The applicator package of claim 1 further comprising a selectively removable cap attachable to the container, the cap dimensioned to cover the pad assembly, the cap having a third annular bearing surface adapted to contact in sealing engagement an inner annular portion of the elastomer strip.

3. The applicator package of claim 2 further comprising a sealing skirt depending from the cap, a lower end of the sealing skirt defining the third annular bearing surface.

4. The applicator package of claim 2 wherein the retainer ring is secured to the container by one of cooperating threads or a bayonet mounting having a first pitch, and the cap is secured to the container by one of cooperating threads or a bayonet mounting having a second pitch opposite the first pitch.

5. The applicator package of claim 1 wherein the elastomer strip is fixed to at least one side of the perimeter edge by one of bonding, welding or overmolding.

6. The applicator package of claim 1 wherein the container is provided with means for pushing product from within the storage reservoir.

7. The applicator package of claim 6 wherein the means for pushing comprises a wall portion of the container that is resiliently deformable sufficiently to temporarily reduce the volume of the storage reservoir.

8. The applicator package of claim 1 wherein the applicator pad assembly defines an application surface, and at least a portion of the application surface is coated with at least one of flocking and grit.

9. The applicator package of claim 1 further comprising a base ring between the container and the retainer ring, the base ring attached to the container about the screen member, and a hinge connecting the base ring to the retainer ring, the retainer ring pivotable on the hinge from a first open position away from the screen member to a second closed position secured about the perforated portion of the screen member.

10. The applicator package of claim 9 wherein the base ring is secured to the container by one of cooperating threads or a bayonet mounting having a first pitch, and the cap is secured to the container by one of cooperating threads or a bayonet mounting having a second pitch opposite the first pitch.

11. A disposable applicator pad assembly for an applicator package having a container defining a storage reservoir and a dispenser opening, the package further having a screen member with a perforated portion, the screen member attached to the container and spanning the dispenser opening such that the perforated portion is in fluid communication with the storage reservoir by way of the dispenser opening, a first annular bearing surface defined on one of the container or the screen member, a retaining ring selectively attachable to the to the container, the retaining ring defining a second annular bearing surface cooperatively dimensioned and adapted to face the first annular bearing surface when the ring is attached to the package, the disposable applicator pad assembly comprising:

a porous foam pad dimensioned to cover and be at least partially supported by the perforated portion of the screen member, the pad having a perimeter edge, and an elastomer strip fixed to the perimeter edge of the pad, at least an outer annular portion of the strip adapted to be received and compressed in sealing engagement between the first annular bearing surface and the second annular bearing surface when the retaining ring is attached to the package.

12. The disposable applicator pad assembly of claim 11 wherein the elastomer strip further comprises an inner annular portion adapted to contact in sealing engagement a third annular bearing surface of a selectively removable cap attachable to the container.

13. The disposable applicator pad assembly of claim 11 wherein the elastomer strip is fixed to the perimeter edge by one of bonding, welding or overmolding.

14. The disposable applicator pad assembly of claim 11 wherein the applicator pad assembly defines an application surface, and at least a portion of the application surface is coated with at least one of flocking and grit.

* * * * *